US006796611B2

(12) United States Patent
Bock

(10) Patent No.: US 6,796,611 B2
(45) Date of Patent: Sep. 28, 2004

(54) SYNCHRONIZING MECHANISM FOR OFFICE CHAIRS

(75) Inventor: Hermann Bock, Pyrbaum (DE)

(73) Assignee: Bock-1 GmbH & Co., Postbauer-Heng (DE)

( * ) Notice: Subject to any disclaimer, the term of this patent is extended or adjusted under 35 U.S.C. 154(b) by 0 days.

(21) Appl. No.: 10/656,101

(22) Filed: Sep. 8, 2003

(65) Prior Publication Data

US 2004/0140703 A1 Jul. 22, 2004

(30) Foreign Application Priority Data

Sep. 7, 2002 (DE) ..... 102 41 562

(51) Int. Cl.[7] ..... A47C 1/032
(52) U.S. Cl. ..... 297/300.5; 297/303.4
(58) Field of Search ..... 297/300.2, 300.5, 297/302.4, 303.4, 303.5

(56) References Cited

U.S. PATENT DOCUMENTS

| | | | | | |
|---|---|---|---|---|---|
| 2,650,646 | A | * | 9/1953 | Herold et al. | 297/300.5 |
| 4,013,258 | A | * | 3/1977 | Doerner | 248/578 |
| 4,653,806 | A | * | 3/1987 | Willi | 297/300.5 |
| 5,160,184 | A | * | 11/1992 | Faiks et al. | 297/300.5 |
| 5,249,839 | A | * | 10/1993 | Faiks et al. | 297/300.1 |
| 5,328,237 | A | * | 7/1994 | Yamaguchi et al. | 297/303.4 |
| 5,397,165 | A | * | 3/1995 | Grin et al. | 297/300.5 |
| 5,564,783 | A | * | 10/1996 | Elzenbeck et al. | 297/300.2 |
| 6,234,573 | B1 | * | 5/2001 | Roder et al. | 297/300.5 |
| 2002/0171276 | A1 | | 11/2002 | Bock | |

FOREIGN PATENT DOCUMENTS

| | | |
|---|---|---|
| DE | 196 07 136 | 8/1996 |
| DE | 298 19 143 U1 | 2/1999 |
| DE | 198 10 768 | 9/1999 |
| DE | 199 22 442 | 11/2000 |
| DE | 100 08 453 | 9/2001 |
| DE | 101 25 994 | 11/2002 |
| EP | 1 127 522 A2 | 8/2001 |
| WO | WO 02/032261 A3 | 4/2002 |

* cited by examiner

*Primary Examiner*—Peter R. Brown
(74) *Attorney, Agent, or Firm*—Browdy and Neimark, P.L.L.C.

(57) ABSTRACT

A synchronizing mechanism for office chairs comprises a base carrier, a backrest carrier, and a seat carrier, which are coupled to one another via corresponding joints. A spring arrangement to actuate the synchronizing mechanism consists essentially of helical compression springs disposed parallel to the longitudinal seat direction flat underneath the seat carrier, wherein for each helical compression spring a counter-bearing extension arm is provided, a front end of which is articulated to the base carrier and a rear-facing end of which, freely projecting, forms a counter bearing for a rear support of the helical compression spring, and wherein the at least one helical compression spring is supported in each case with its front end on a counter bearing formed on the seat carrier.

15 Claims, 14 Drawing Sheets

SYNCHRONIZING MECHANISM FOR OFFICE CHAIRS

BACKGROUND OF THE INVENTION

1. Field of the Invention

The present invention is concerned with a synchronizing mechanism for office chairs as they are known from DE 198 10 768 A1 or DE 101 25 994 A1, which accords to U.S. patent application Ser. No. 10/147,033 and is based on an older application of the applicant's.

2. Background Art

The term "synchronizing mechanism" means structural components in the substructure of an office chair, which provide for kinematics that involve a certain coupled motion of the seat relative to the backrest. Placed on a chair column is a base carrier on which, on the one hand, is mounted a seat carrier, which is pivotable about a transverse axis and articulated to the base carrier and, on the other hand, a backrest carrier, which is also pivotable about a transverse axis and articulated to the base carrier. Mounted on the seat carrier is the seat of the office chair, which is as a rule provided with an upholstered seat surface. Conventionally, the backrest carrier extends backwards from the actual synchronizing mechanism, supporting the backrest of the office chair on an upward extension arm.

The seat carrier and backrest carrier are coupled in an articulated fashion such that pivoting the backrest backwards—which is caused for instance when a person sitting on the chair leans back against the backrest—induces a lowering motion of the rear edge of the seat. This correlated seat-backrest motion brings with it a considerable comfort value and is desirable for orthopedic reasons.

To permit a backward downward pivoting of the backrest and seat in the case of a pure pivot-coupling of the backrest carrier to the base carrier and seat carrier, a degree of freedom must be introduced into the mechanism that permits the seat carrier to be shifted backwards while simultaneously allowing it to pivot about its front end. To this extent, the printed specifications of the prior art mentioned at the beginning reveal a turning-and-sliding joint between the base carrier and front end of the seat carrier. Depending on whether and how pronounced an elevating motion of the front edge of the seat is desired during the sliding-pivoting motion, the elongated-hole-type sliding guide for the seat carrier is either more steep, as in DE 198 10 768, or more flat, as in DE 101 25 994 A1 which accords to U.S. application Ser. No. 10/147,033.

An additional fundamental fact with synchronizing mechanisms lies in their spring action that counters the pivoting towards the rear. A multitude of spring designs is known from the prior art to achieve this. In the synchronizing mechanism according to DE 198 10 768 A1, the combination of a gas and a helical compression spring is provided, which extends as a relatively high unit under the seat carrier. One point of action of this spring arrangement is the front bearing end of the seat carrier; with its rear-facing end the spring arrangement is supported in a counter bearing in front of the cone receptacle for the seat carrier.

The spring arrangement provided in the design according to DE 101 25 994 A1, corresponding to U.S. application Ser. No. 10/147,033, is based on two leg springs that are housed in the base carrier. One leg of the spring is housed in an adjusting arrangement in the base carrier, whereas the second leg projects upward toward the seat carrier, which is supported on this leg by means of a corresponding counter bearing, and its backward pivoting direction is countered in this manner.

Both spring arrangements according to the prior art take up a considerable amount of the available component space in the base carrier, so that relatively narrow margins are set for its free design. Specifically, when known synchronizing mechanisms of this type are used, the base carriers, for optical-esthetic reasons, will have relatively voluminous casings to hide the spring arrangement and associated adjusting elements as best as possible.

Regarding the problems concerning the adjustability of the pretension of the spring arrangement, reference is made to DE 100 08 453 C2, which reveals a spring package with spring units that can be selectively switched on and off to vary the spring pretension and, hence, the counterforce against the pivoting. The spring arrangement itself, however, in this case is disposed between the base carrier and a one-piece combined seat and backrest carrier, which can be swiveled back as a whole. This does not represent a synchronizing mechanism per se.

SUMMARY OF THE INVENTION

The invention has as its object to improve a synchronizing mechanism for office chairs in such a way that the spring arrangements, while having a simple design, can be disposed particularly compact and specifically in closer spatial proximity underneath the seat carrier, so that the region of the base carrier essentially remains free while attaining the greatest degree of freedom for design options.

This object is met by the invention, according to which the spring arrangement incorporates at least one helical compression spring disposed essentially parallel to the sliding direction of the seat carrier flat underneath it, wherein for each helical compression spring, a counter-bearing extension arm is provided, the front end of which is articulated to the base carrier and the rear-facing end of which, freely projecting, forms a counter bearing for the rear support of the helical compression spring, and the at least one helical compression spring is supported in each case with its front end on a counter bearing formed on the seat carrier.

Based on the described design, the entire spring arrangement is connected practically only via its front end to the remaining kinematics of the synchronizing mechanism. Proceeding from the front end of the counter-bearing extension arm, which is disposed at the height of the turning-and-sliding joint between the seat carrier and base carrier, the spring arrangement extends practically horizontally backwards along the seat carrier. Due to its flat design it has a very low construction height. Additionally, since no connecting elements are present at all that project downward toward the backrest carrier or base carrier, this region can be taken up by other construction and design elements of the chair as desired.

The basic design of the spring arrangement based on the counter-bearing extension arm also permits preferred improvements wherein the pretension of the spring arrangement can be adjusted in a simple manner. The counter-bearing extension arm must merely be supported sliding in the longitudinal direction of the seat. A sliding in the longitudinal direction changes the position of the counter bearing for the rear support of the helical compression spring, which, as a result, is compressed either to a greater or lesser degree with a corresponding change in the pretension. The sliding of the counter-bearing extension arm is preferably implemented by means of an adjusting shaft with eccentric cams.

According to an additional preferred embodiment, the spring arrangement is provided in the form of a spring package of multiple helical compression springs, the combined pretension of which is variable through a varying gradation in narrow steps of the individual eccentric cams of the adjusting shaft. This has the advantage on the one hand that a good balancing of the counterforce can be attained in the synchronizing mechanism with a wide absolute range of variations. As opposed to the design according to the above-mentioned DE 100 08 453 C2, the possibility to switch individual springs on or off is completely dispensed with.

Additional preferred embodiments of the invention provide for the design of the counter-bearing extension arms as rods on which the helical compression springs are placed. The helical compression springs may be supported via a bearing strip on the counter bearing of the seat carrier, said bearing strip being pivotably slide-mounted inside a bearing cutout of the counter bearing. The support of the helical compression spring towards the seat carrier is improved in this manner since a certain swivel angle must be offset in the support for the helical compression spring due to the rearward downward movement of the seat carrier plate when the synchronizing mechanism is actuated.

Additional preferred embodiments relate to the design of the bearing head of the given counter-bearing extension arm in the form of a frame, which is used on one hand to support the counter-bearing extension arm on the base carrier, and on the other hand as a working surface for the eccentric cams of the adjusting shaft.

According to additional preferred embodiments, a supplemental counter bearing that is adjustable in the longitudinal seat direction is provided on at least one counter-bearing extension arm at its rear-facing end. It allows for the helical compression spring on this counter-bearing extension arm to be varied in its initial pretension so that, together with the adjustability of the counter-bearing extension arm itself, at least two different counterforce ranges are provided to adjust the synchronizing mechanism to light-weight or heavy-weight persons. Within these ranges, a fine-tuning can then be performed via the actual adjustment of the counter-bearing extension arms.

Lastly, in an additional variant of the invention, the at least one counter-bearing extension arm is executed as an adjusting shaft, which, on the one hand is rotation-drivable by an actuator on the base carrier, and on the other hand is provided with its rear-facing end with an adjustable counter-bearing end stop. The same is adjustable spindle-like by a rotation of the shaft in the direction of the spring force of the helical compression spring, so that the pretension of the helical compression springs is adjustable in a simple manner across wide ranges simply by operating the actuator.

The actuator is preferably formed by a manually operated actuation shaft located in the front region of the base carrier and coupled via a deflection gear to the front end of the adjusting shafts. Adjusting the spring pretension can thus be accomplished conveniently by means of a turning knob at the end of the actuating shaft laterally projecting from the chair.

A structurally simple support of the adjusting shafts is obtained in such a way that they are rotatably supported with their front end in a bearing yoke disposed on a deflection gear shaft. To attain a compact method of construction the deflection gear is formed as a bevel gear in each case between an adjusting shaft and a gear shaft driven by the actuating shaft. Additional characteristics, details and advantages of the invention will become apparent from the following description, in which one embodiment of the subject of the invention will be explained in more detail based on the drawings.

DESCRIPTION OF A PREFERRED EMBODIMENT

Figure 1:
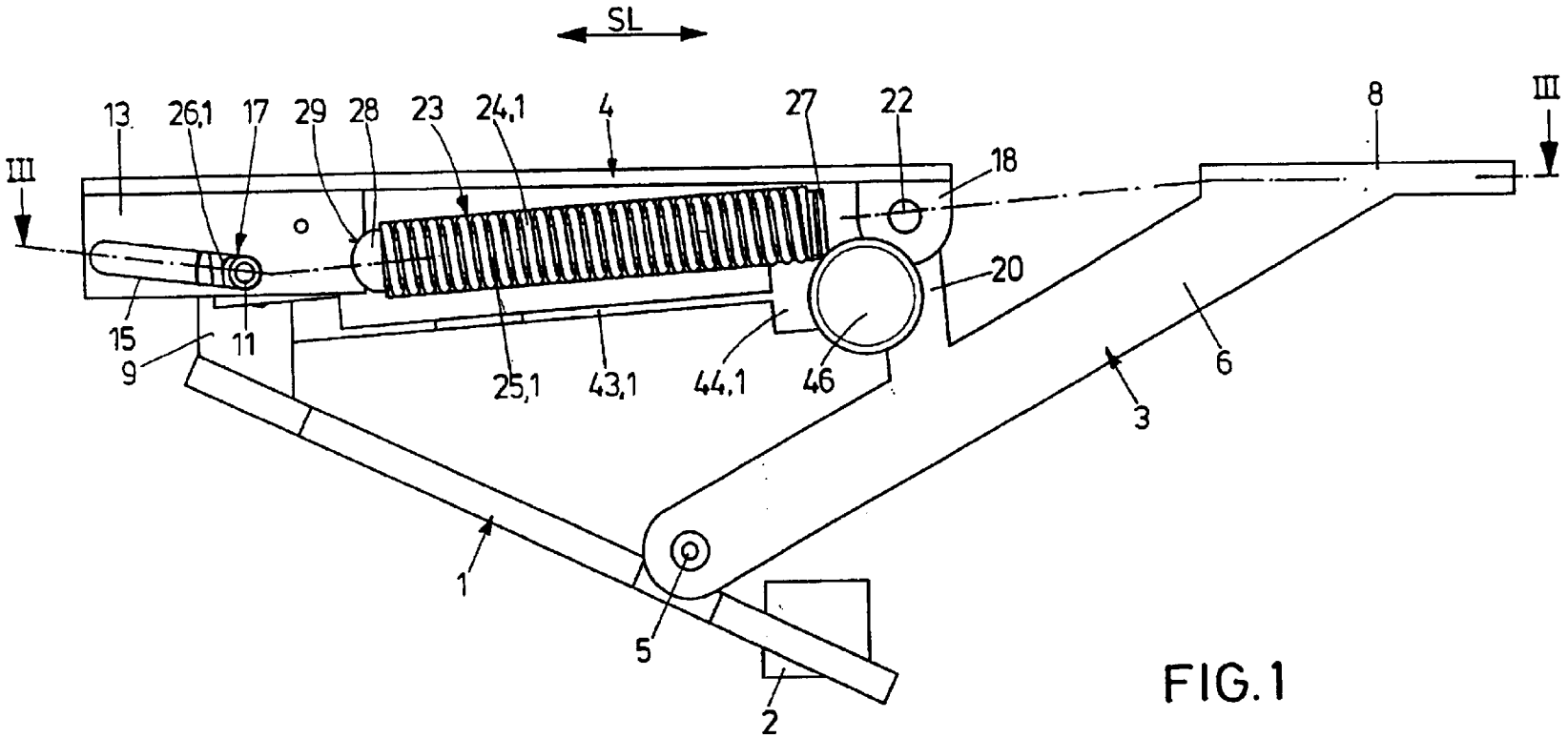
FIGS. 1 and 2 show a side and front view of a synchronizing mechanism in a first embodiment.
Figure 2:
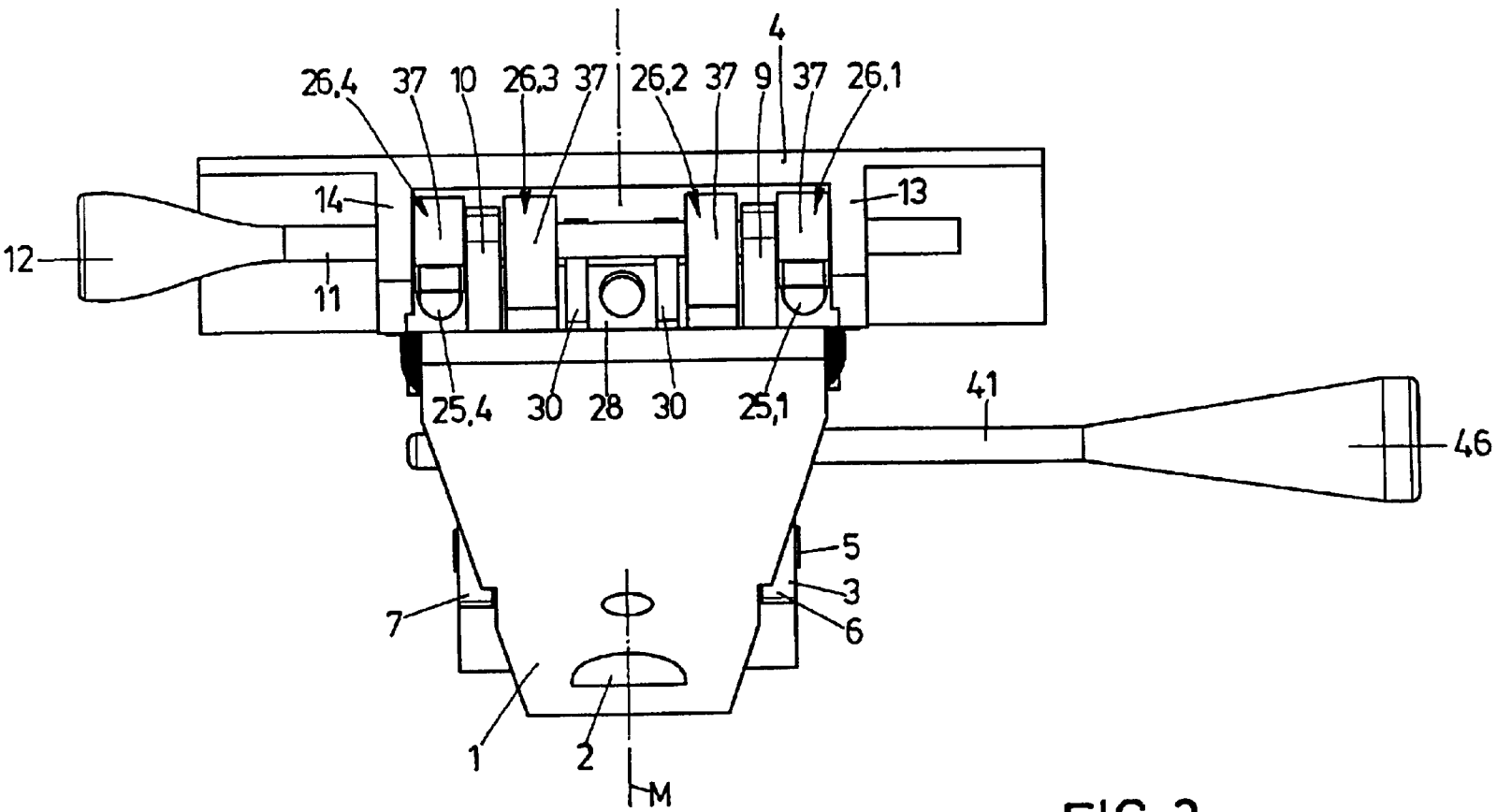
Figure 3:
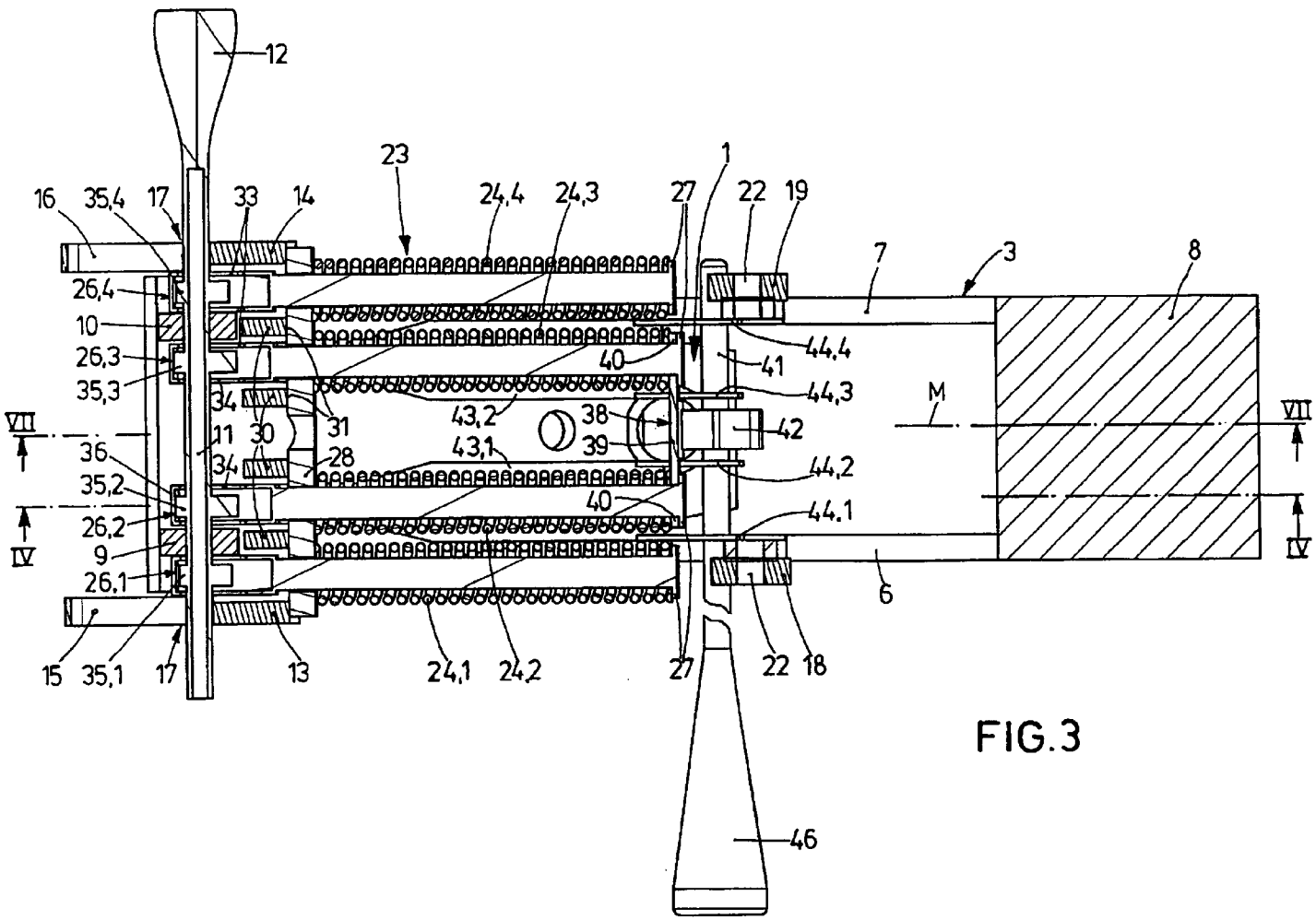
FIG. 3 shows an essentially horizontal section through the synchronizing mechanism along the section line III—III of FIG. 1.
Figure 4:
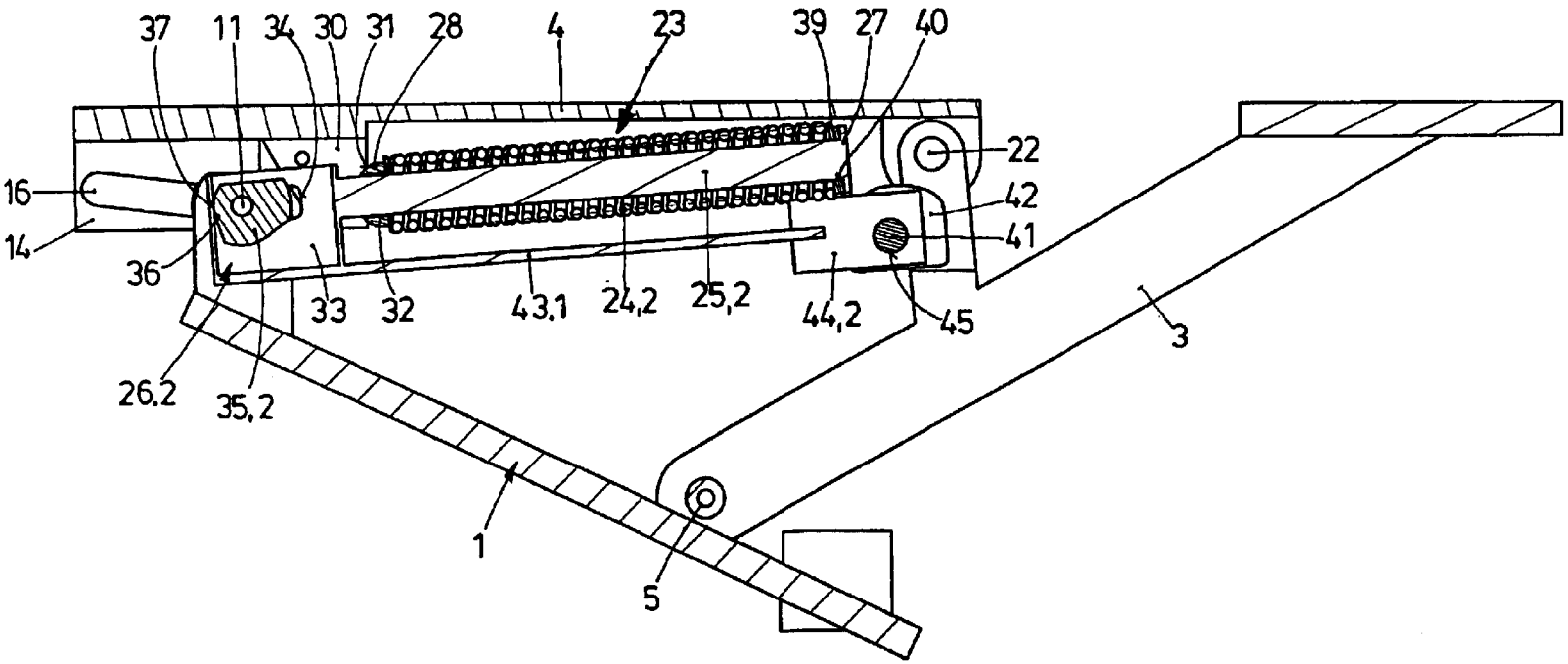
FIG. 4 shows a vertical section along the section line IV—IV according to FIG. 3, FIGS. 5 and 6 show sections analogous to FIGS. 3 and 4 with an altered spring pretension.
Figure 5:
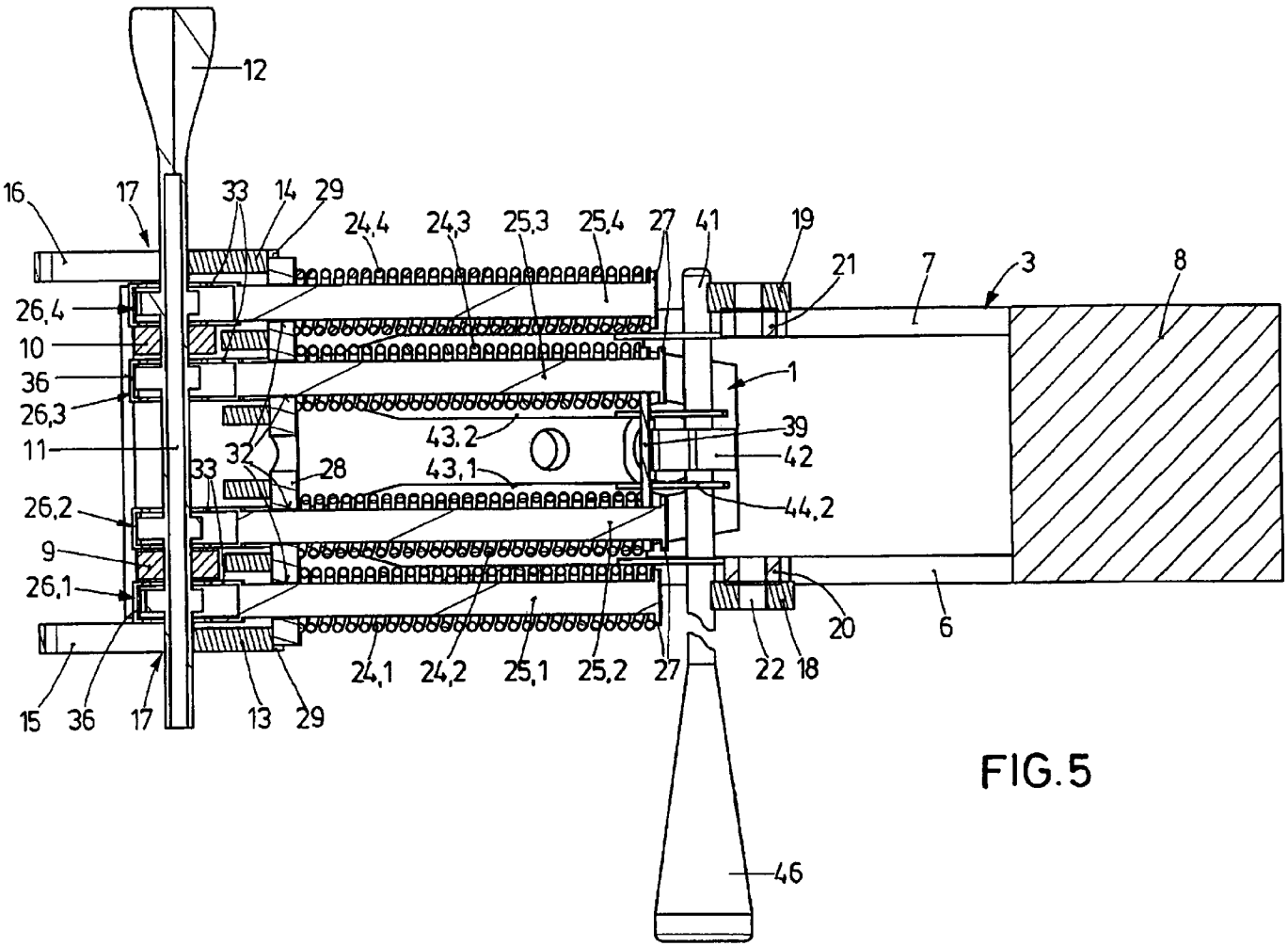
Figure 6:
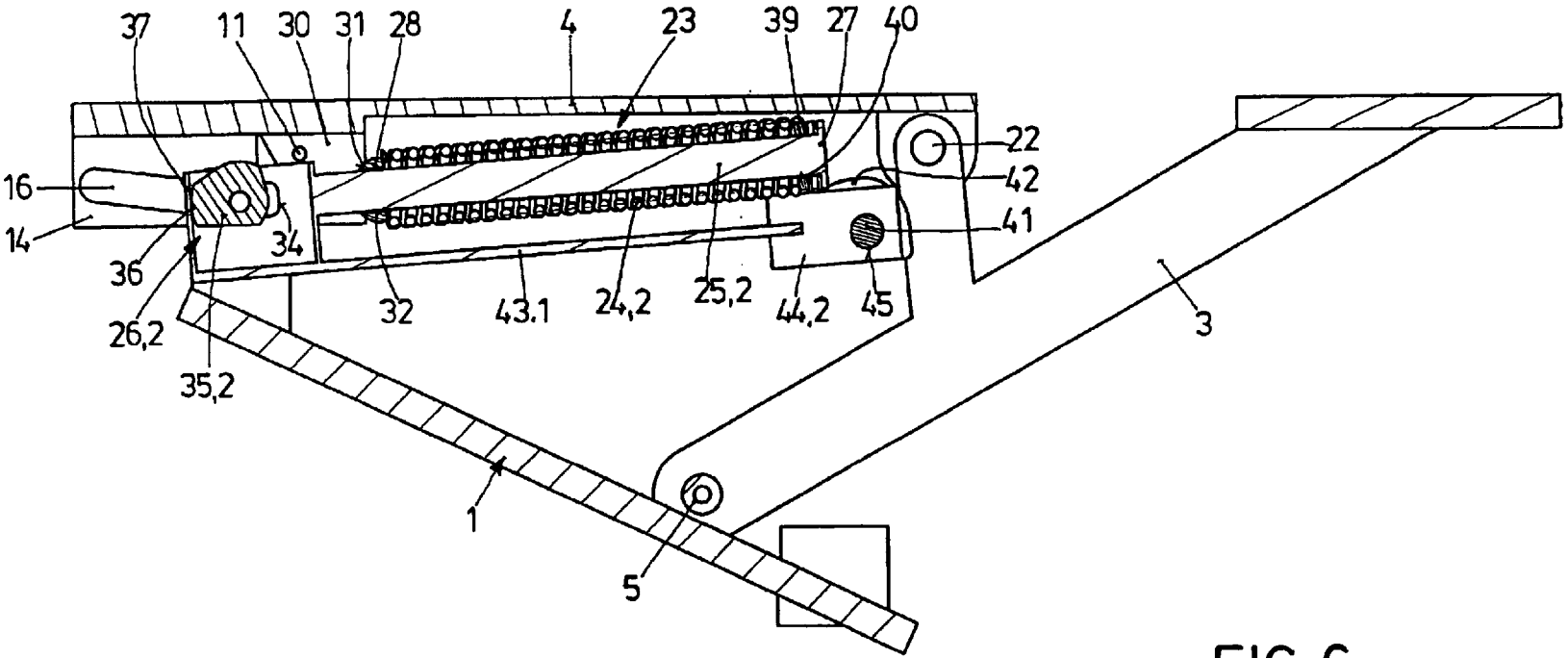
Figure 7:
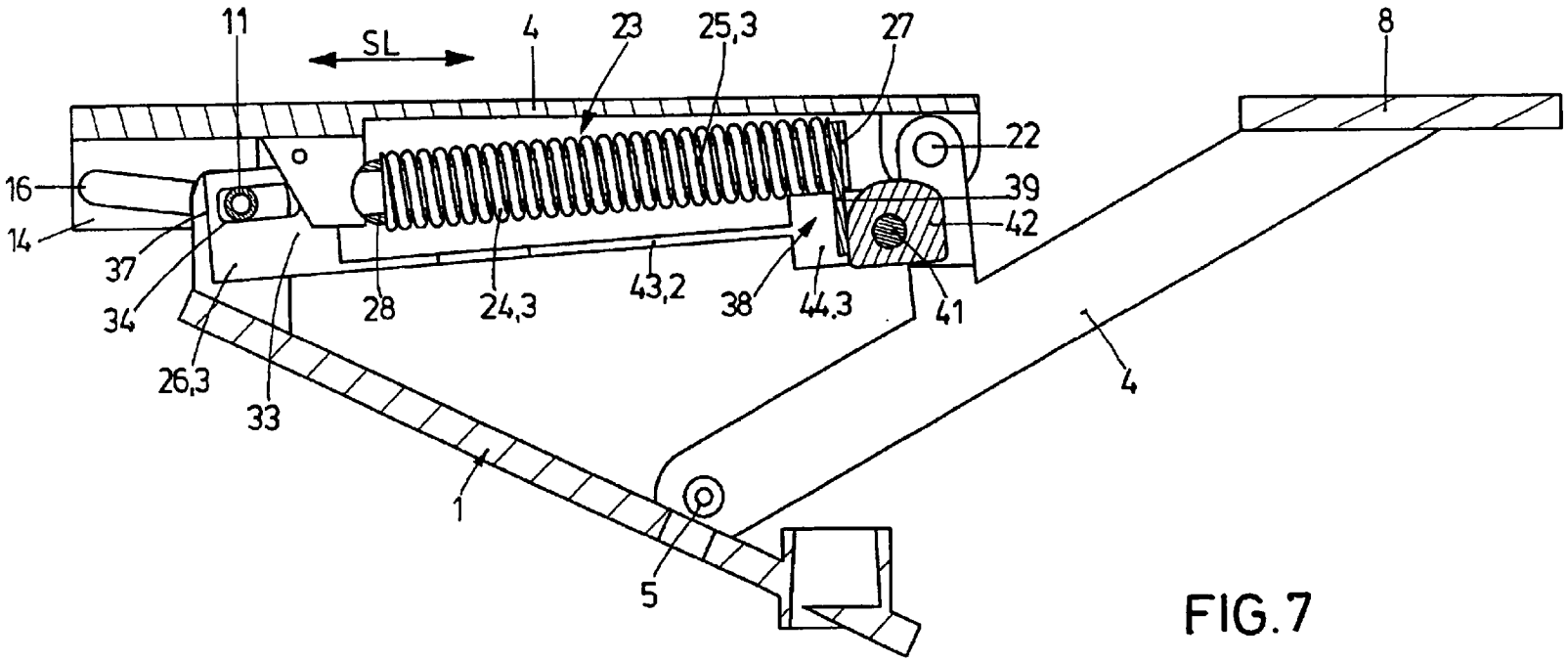
FIGS. 7 and 8 show centrally placed vertical sections through the synchronizing mechanism along the section line VII—VII according to FIG. 3 with different positions of the supplemental counter bearing.
Figure 8:
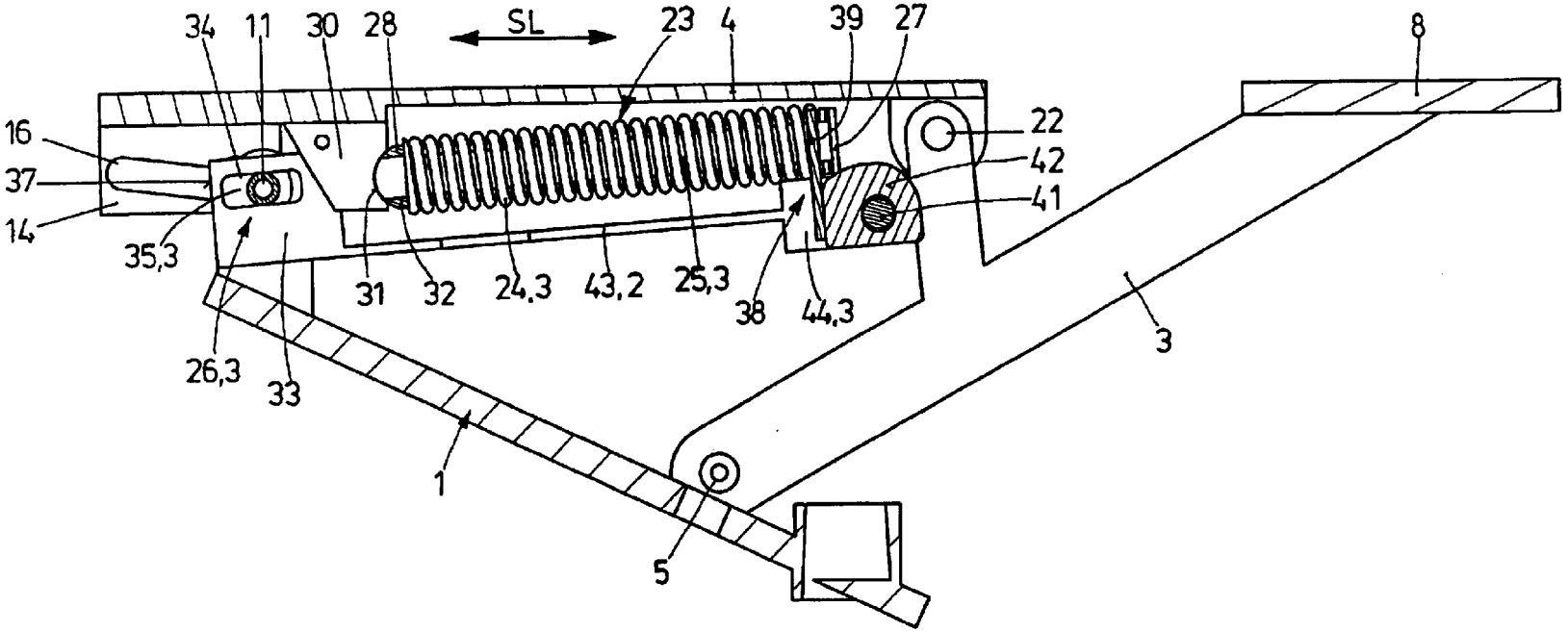

The basic design of the synchronizing mechanism will now be explained based on FIGS. 1 through 4. Provided as a carrying element is a base carrier 1, which is provided in the region of its back end with a cone receptacle 2 to place the synchronizing mechanism onto the upper end of a chair column (not shown). Additional basic components of the synchronizing mechanism are the backrest carrier 3 and seat carrier 4. The backrest carrier 3 is supported pivoting on the base carrier 1 a short distance in front of the cone receptacle 2 via a transverse axis 5. The backrest carrier consists of two side braces 6, 7 that extend obliquely back and up and, at their back ends, end in a backrest base 8, which is shown only schematically.

In the front end region of the base carrier 1, which widens towards the front, integral upwardly projecting bearing posts 9, 10 are provided on both sides of the center longitudinal plane M, inside which an adjusting shaft 11 with a turning knob 12 at one end is rotatably supported as a transverse axis.

The essentially plate-shaped seat carrier 4 incorporates, in the region of its front end, two downwardly projecting lateral cheeks 13, 14, which are provided with an elongated hole 15, 16 that has a slight rearward slope in the longitudinal seat direction SL. With these elongated holes 15, 16, the seat carrier 4 sits on the adjusting shaft 11 in such a way that the engagement of these two components forms a turning-and-sliding joint 17 between the base carrier 1 and seat carrier 4, i.e., the seat carrier 4 can pivot about the adjusting shaft 11 and simultaneously slide relative to same in the direction of the elongated holes 15, 16.

In the region of its rear-facing end, the seat carrier 4 is provided with two also laterally downward projecting bearing lugs 18, 19, which together with a corresponding upwardly projecting bearing projection 20, 21, form a pivot bearing at the two lateral braces 6,7 of the backrest carrier 3 about a transverse axis 22.

To actuate the synchronizing mechanism in the opposite direction of the synchronized adjusting movement from the initial position shown in FIGS. 1 through 4, a spring arrangement is provided, which is denoted by 23 in its entirety, which incorporates four helical compression springs 24.1 through 24.4 (denoted below by the joint reference numeral 24 unless an individual helical compression spring requires a separate explanation) that are disposed parallel to one another on both sides of the center longitudinal plane M. For each helical compression spring 24, a counter-bearing extension arm 25.1 through 25.4 is provided in each case, the front end of which is articulated swiveling relative to the base carrier 1 on a bearing head 26.1 through 26.4. The rod-shaped shaft of the counter-bearing extension arm 25 extends freely projecting towards the rear where it is provided with a counter-bearing projection 27. Supported on same is the back end of the helical compression springs 24.

Their front end sits on a bearing strip 28 as a counter bearing that is semicircular in cross-section and extends perpendicular to the longitudinal seat direction SL and horizontally, and which, with its semi-cylindrical front-facing outer face, is supported in corresponding inwardly cylindrical bearing cutouts 29 at the rear-facing end of the cheeks 13, 14 of the seat carrier 4. Additionally provided between the counter-bearing extension arms 25 are additional intermediate posts 30 downwardly extending from the seat carrier 4, which incorporate bearing cutouts 31 that are flush with the bearing cutouts 29 for an additional counter support of the bearing strip 28. The pressure force of the helical compression springs 24 that are clamped-in between the counter-bearing projection 27 and bearing strip 28 places a forward pressure on the seat carrier 4 into the initial position shown in FIGS. 1 through 4.

The counter-bearing extension arms 25 with their rod-shaped shafts pass through the bearing strip 28 via through-openings 32.

The bearing head 26 at the front end of the counter-bearing extension arms 25 is designed as an at least frame-shaped or box-shaped part, the lateral frame walls 33 of which that extend parallel to the longitudinal seat direction SL are in each case provided with an elongated hole 34 whereby the counter-bearing extension arms 25 are mounted pivoting on the adjusting shaft 11 and slideable relative thereto in the longitudinal seat direction SL. On the adjusting shaft 11 eccentric cams 35.1 through 35.4 are connected within the bearing heads to the adjusting shaft 11 to be integral in rotation therewith, at the given front-facing eccentric flank 36 of which the front-facing frame wall 37 of the bearing head 26 is supported in each case. The contact between the frame wall 37 and eccentric flank 36 is secured through the pressure force of the helical compression springs 24.

Regarding the basic configuration of the synchronizing mechanism, it should be noted that, due to the spring arrangement 23, the seat carrier 4 is acted upon by the pretension of the helical compression springs 24 in a forward direction relative to the base carrier 1, so that it comes to rest with the back ends of its elongated holes 15, 16 at the adjusting shaft 11 in the initial position shown in FIGS. 1 through 4. The backrest carrier 3 is in its maximally upright position at this time.

If the pretension of the helical compression springs 24 is to be changed now, all that is required is to turn the adjusting shaft 11. Its eccentric cams 35 then shift the counter-bearing extension arms 25 further toward the front, for example, so that the rear counter-bearing projection 27 is moved closer to the bearing strip 28. The helical compression springs 24 are compressed to a greater degree by this and exert a greater pressure force onto the bearing strip 28 and, hence, onto the seat carrier 4. The eccentric cams 35 may incorporate different degrees of eccentricity and inclines, which is not clearly shown by the drawings, so that different helical compression springs 24 are compressed or released to varying degrees when the adjusting shaft 11 is actuated.

To create an additional adjustability for the pretension of the inner helical compression springs 24.2 and 24.3, an adjustable supplemental counter bearing 38 is provided. This is primarily a plate-shaped slider 39 that is disposed vertically, perpendicular to the longitudinal seat direction SL, which is slideably guided in the longitudinal seat direction SL with two bearing openings 40 on the two inner counter-bearing extension arms 25.2, 25.3. This slider 39 is inserted between the two helical compression springs 24.2, 24.3 and their counter-bearing projection 27.2, 27.3. It acts together with a further eccentric cam shaft 41, the eccentric cam 42 of which is located centrally in the center longitudinal plane M and acts upon the slider 39 from behind.

The mounting of the eccentric cam shaft 41 takes place via two bearing braces 43.1, 43.2, each of which extend backwards from the underside of the bearing heads 26.3, 26.3 parallel to the lower counter-bearing extension arms 25.2, 25.3. On their free ends these bearing braces 43 incorporate four upright bearing plates 44.1 through 44.4, which are provided with bearing eyes 45 that are flush with one another. Sitting in these is the eccentric cam shaft 41, which can be actuated via a lateral turning knob 46.

If the pretension of the spring arrangement 23 is now to be adjusted to a heavy-weight person, the eccentric cam shaft 41 is actuated via the turning knob 46, and its eccentric cams 42 displaces the slider 39 forward on the counter-bearing extension arms 25.2, 25.3. The helical compression springs 24.2, 24.3 are compressed to a greater degree while increasing the pressure force. The adjusting range of the spring force that is attainable through the adjusting shaft 11 is maintained in the process, as an actuation of the adjusting shaft 11 results in the entire supplemental counter bearing 38 also being shifted, so that the two already more tightly compressed helical compression springs 24.2, 24.3 are compressed further.

Figure 9:
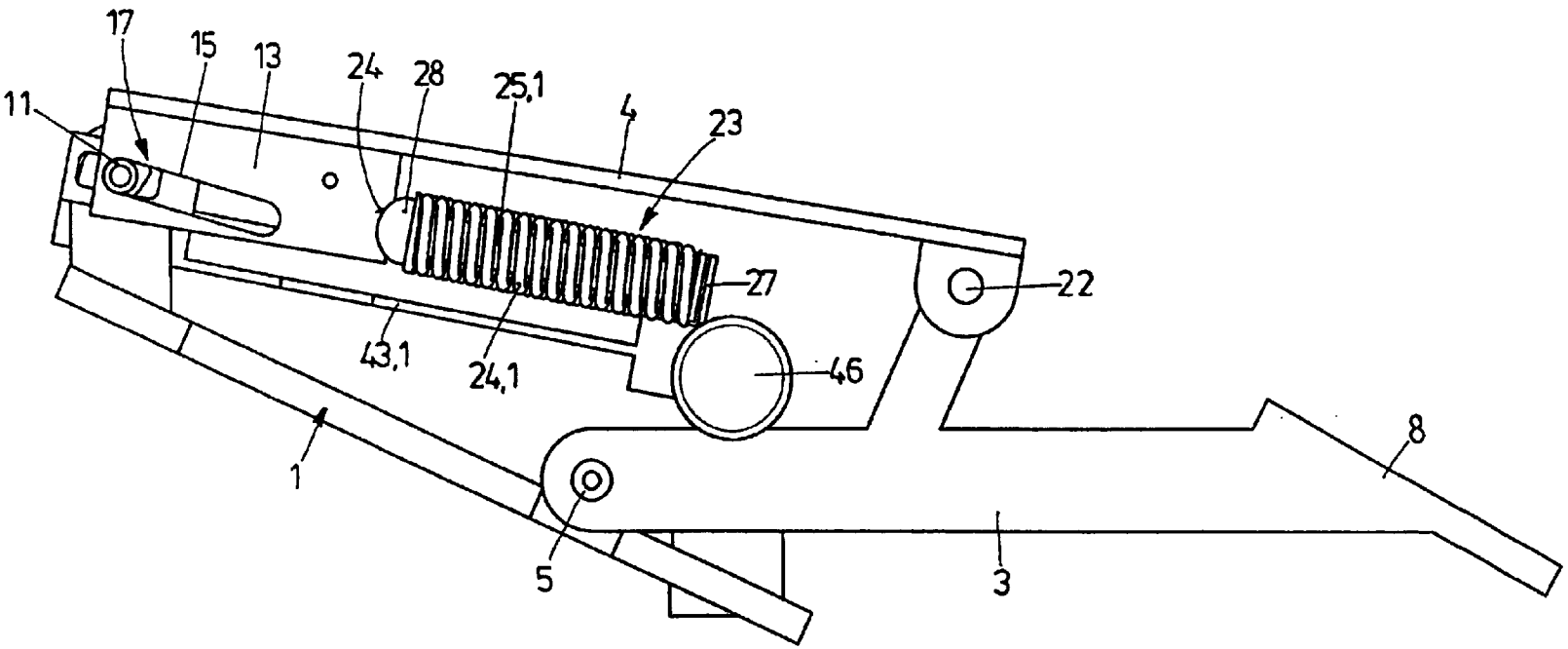
FIGS. 9, 10 and 11 show sections analogous to FIGS. 1, 3 and 7 in a position of the synchronizing mechanism that is pivoted back.
Figure 10:
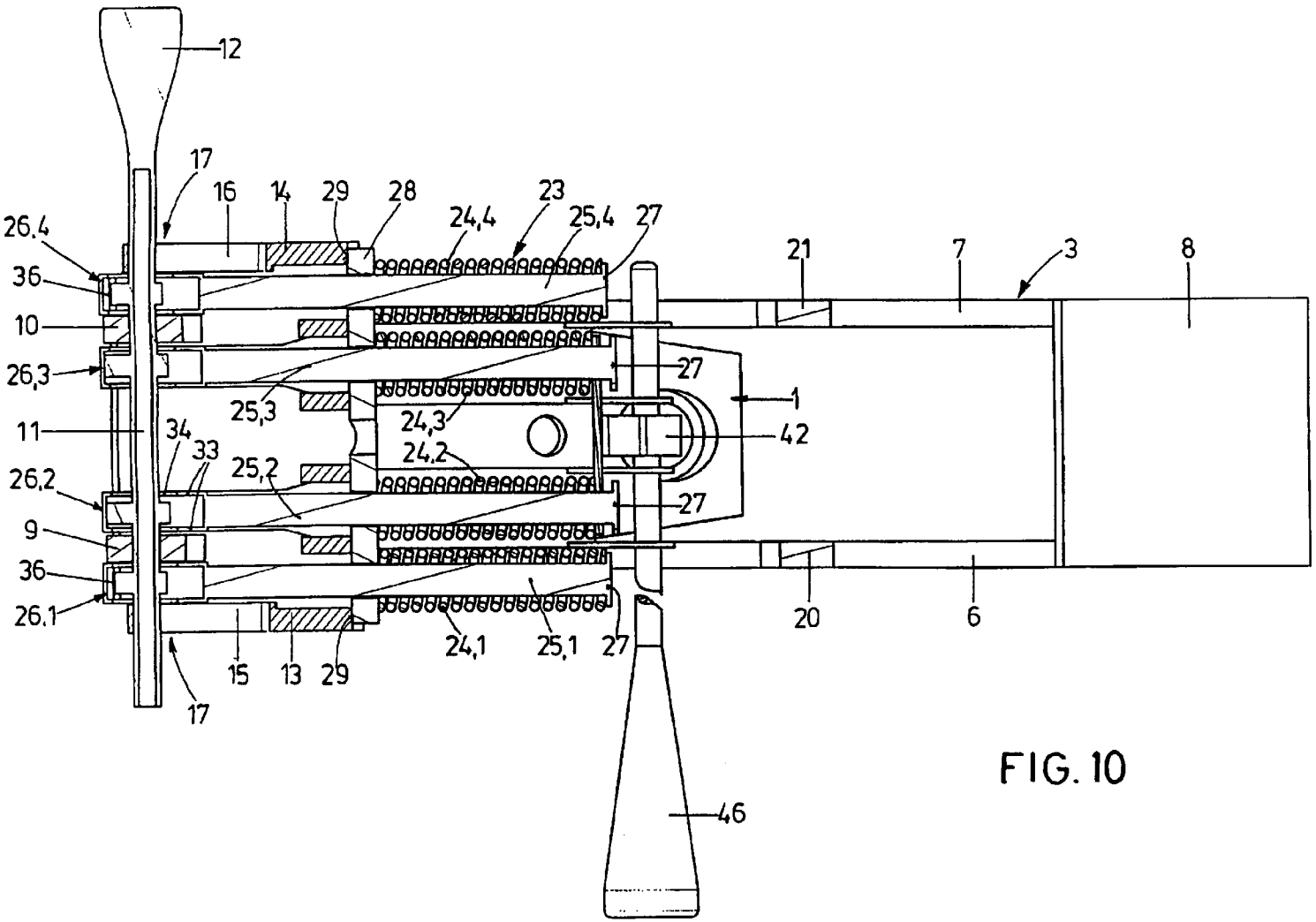
Figure 11:
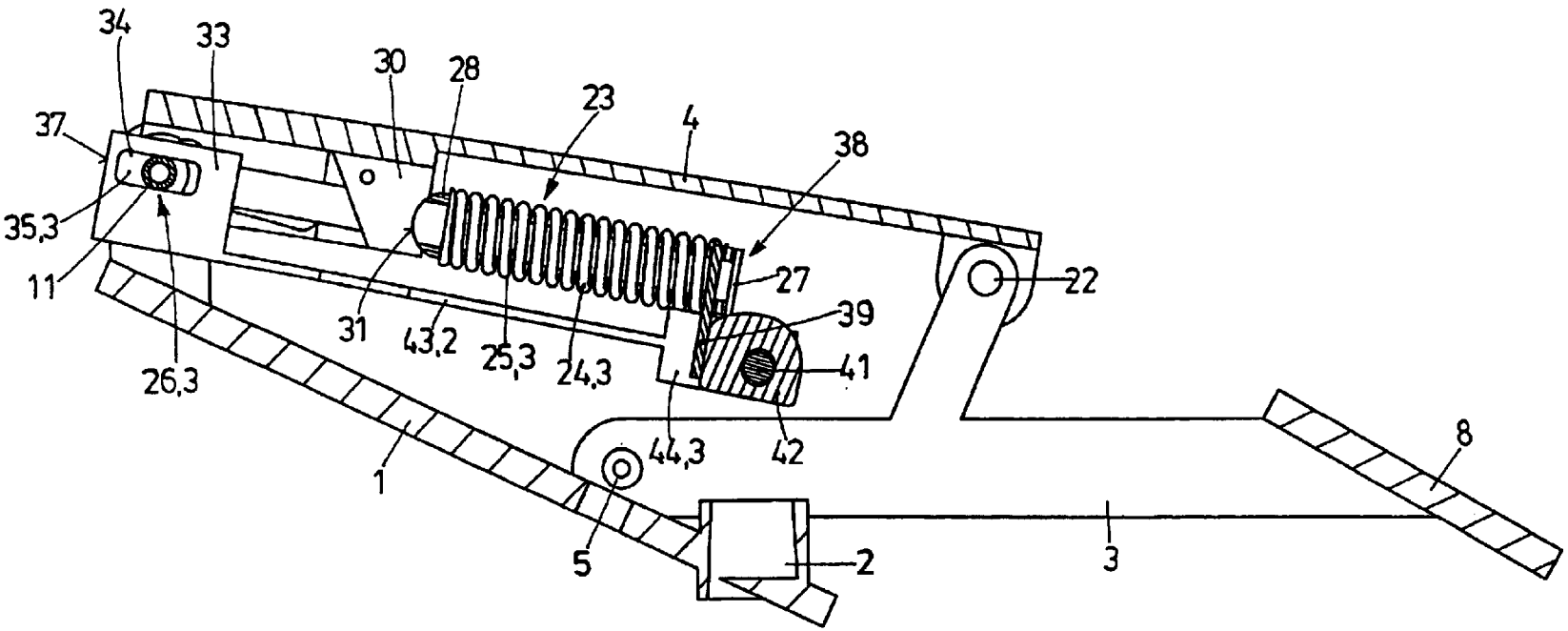

The operation principle of the synchronizing mechanism can be explained based on FIGS. 9 through 11 in conjunction with FIGS. 1 through 4. If the backrest is pushed back, the backrest carrier 3 is pivoted backwards, which thus pivots the seat carrier 4 back and downward about the turning-and-sliding joint 17. In the process, the bearing strip 28 is displaced closer toward the end of the counter-bearing extension arms 25, so that the helical compression springs 24 are compressed to a greater degree, thus building up a greater counterforce. The turning and sliding motion can be performed until the adjusting shaft 11 bounds against the back end of the elongated holes 15, 16 on the seat carrier.

If the backrest is freed of the load, the seat carrier 4 is swiveled back upward to the front by the helical compression springs 24, with the backrest carrier again swiveling with it. This motion is again delimited by the bounding of the adjusting shaft 11 against the front end of the elongated holes 15, 16.

Figure 12:
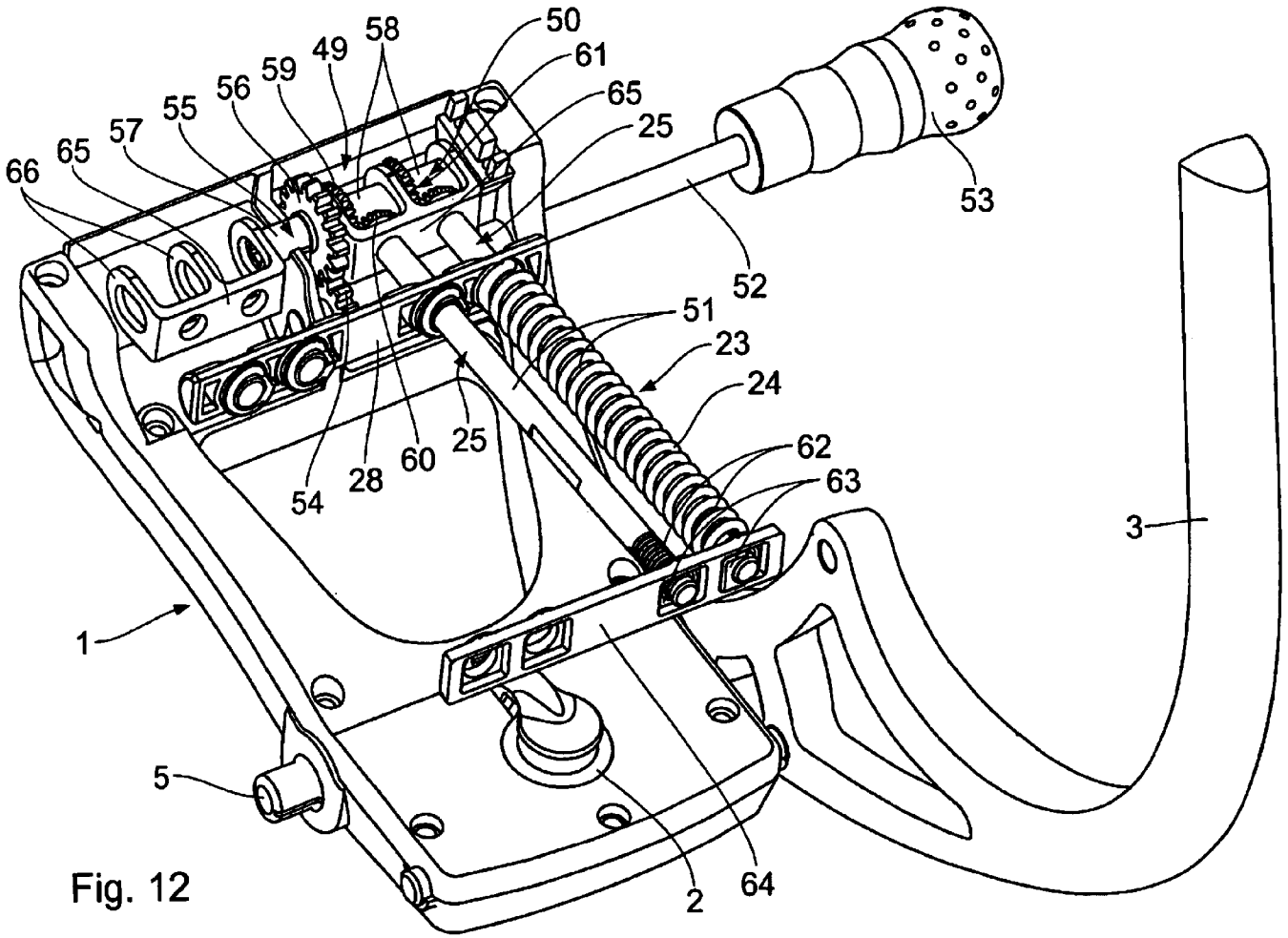
FIG. 12 shows a sectional rendering in the perspective of a synchronizing mechanism in a second embodiment, viewed diagonally from behind.
Figure 13:
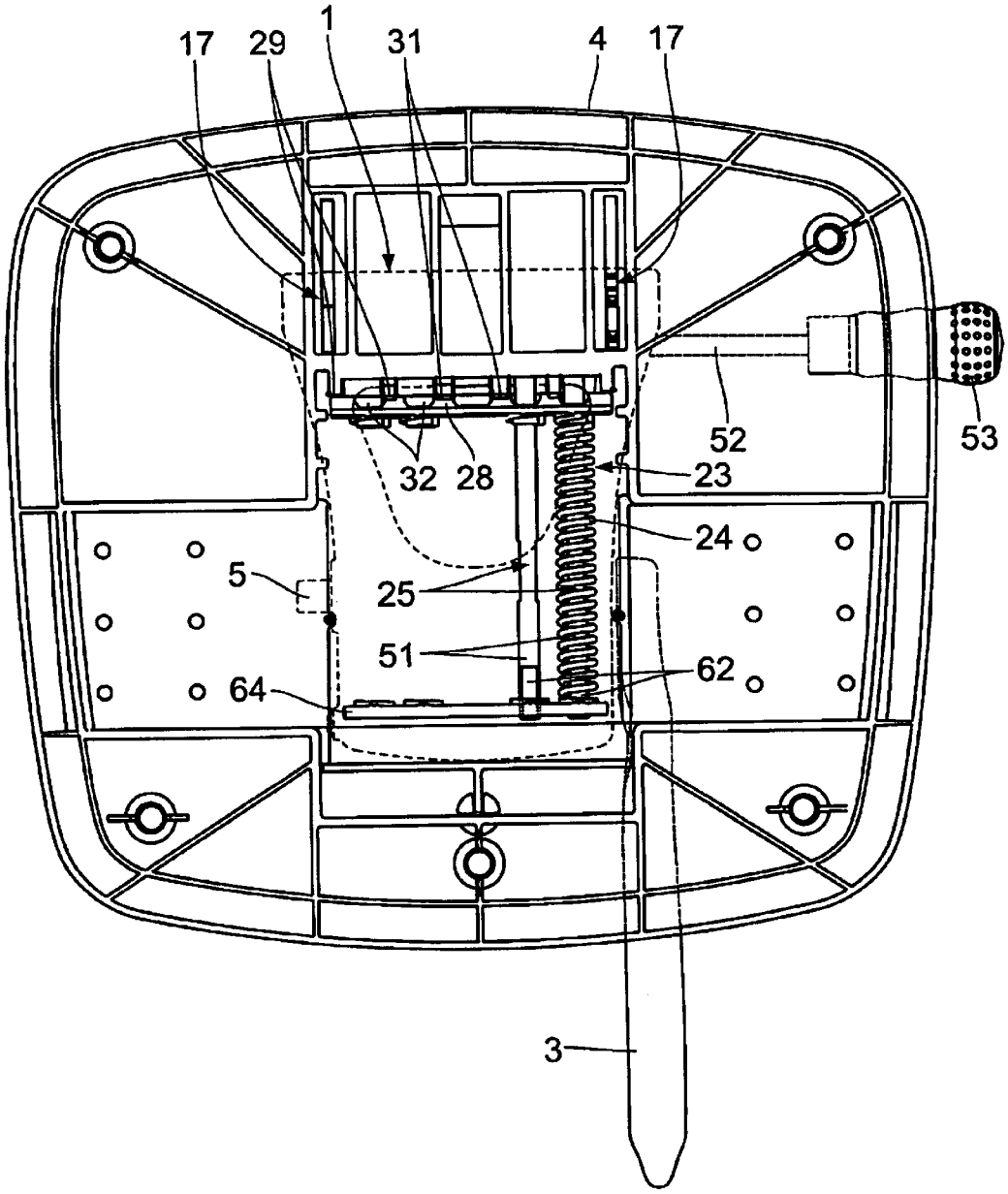
FIGS. 13 and 14 show a top view and side view of the synchronizing mechanism according to FIG. 12.
Figure 14:
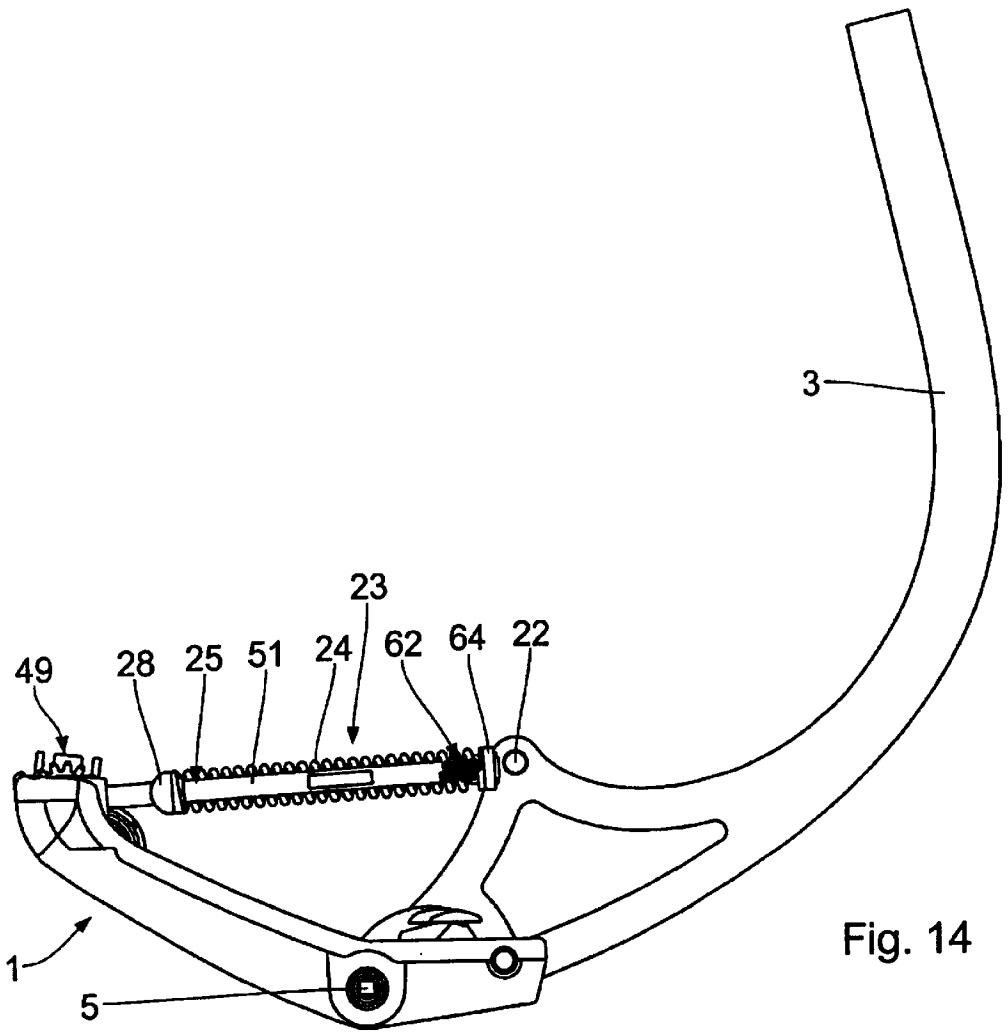

A second embodiment of an inventive synchronizing mechanism is shown in FIGS. 12 through 14. To avoid repetitions, it is pointed out in this context that the basic elements of the synchronizing mechanism, such as the base carrier 1, backrest carrier 3, and seat carrier 4, are identical to the embodiment according to FIGS. 1 through 11 in their mutual coupling via transverse axes 5, 22 and their turning-and-sliding joint 17. To this extent, identical reference numerals will be used in the embodiment according to FIGS. 12 through 14 for such elements with identical construction and functions, and reference is made for their explanation to the corresponding explanations in conjunction with FIGS. 1 through 11.

The following will be a description of only the alternate design and support of the counter-bearing extension arms 25 that carry the helical compression springs 24. Accordingly, while these counter-bearing extension arms 25 are again articulated pivoting in principle with their front end to the base carrier 1, there is integrated into the articulation, however, an actuator, which is denoted by 50 in its entirety, for a rotation of the counter-bearing extension arms 25 that function as the adjusting shaft 51. This actuator 50 incorporates an actuating shaft 52 that is rotatably supported perpendicular to the orientation of the adjusting shafts 51 below same on the base carrier 1, said actuating shaft 52 projecting to one side of the base carrier 1 and provided there with a turning knob 53. Within the base carrier 1 the actuating shaft 52 is provided with a gearwheel 54 of a step-down gear 55, the gear-wheel 56 of which on the driven side is disposed on an intermediate shaft 57, which is also supported in the base carrier 1. This intermediate shaft 57 is completed by shaft stumps 58 that can be slipped on coaxially, on which bevel wheels 59 are disposed in each case. Together with corresponding bevel wheels 60 at the front ends of the adjusting shafts 51 that form the counter-bearing extension arms 25, they form a bevel gear 61 in each case, which, in turn, together with the step-down gear 55 forms what is referred to in its entirety as the deflection gear 49. With it, a rotation of the actuating shaft 52 is transformed into a rotary motion of the adjusting shafts 51.

The adjusting shafts 51 are provided at their rear-facing end in each case with threads 62 that have spindle nuts 63 in engagement with them. These spindle nuts 63 are connected by a common counter-bearing locking bar that extends perpendicular to the orientation of the adjusting shafts 51, and on which the helical compression springs 24 are in each case supported with their back end. Their front end is supported—as in the embodiment according to FIG. 1—on a bearing strip 28 that is supported pivoting in a half-round bearing cup (not visible in FIGS. 12 through 14) that is supported on the seat carrier 4.

It remains to be added that the front ends of the adjusting shafts 51 that extend through the bearing strip 28 are rotatably supported in pairs in bearing yokes 65, which in turn are supported pivoting with bearing projections 66 on the intermediate shaft 57. The adjusting shafts 51 are thus supported not only rotatable about their longitudinal axis but also pivotable about the intermediate shaft 57, so that the adjusting shafts 51 can join in the execution of the slight backward and downward tilting motion of the seat carrier 4. During this motion the seat carrier 4 is shifted backwards with the bearing strip 28 against the force of the helical compression springs 24. This counterforce is variable by an adjustment of the rear counter-bearing locking bar 64. it needs to be pointed out that in FIGS. 12 through 14, components, such as two adjusting shafts 51 in the left half of FIGS. 12 and 14, as well as the parts of the deflection gear 49 located there, the left leg of the backrest carrier 3, and the seat carrier 4, have been left out for ease of viewing of the assembly.

What is claimed is:

1. A synchronizing mechanism for office chairs, comprising a base carrier (1) to be placed on a chair column, a backrest carrier (3), which is articulated to the base carrier (1) such that it is pivotable about a transverse axis (5), a seat carrier (4), which is pivotable about a transverse axis (11) in A region of its front end via a turning-and-sliding joint (17) and slideable in a longitudinal direction (SL) of the seat together with the base carrier (1), and coupled with the backrest carrier (3) such that it pivots in a region of its back end about a transverse axis (22), as well as a spring arrangement (23) to actuate the synchronizing mechanism to counter its synchronized adjusting motion of the seat carrier (4) and backrest carrier (3), wherein the spring arrangement (23) incorporates at least one helical compression spring (24) disposed essentially parallel to a sliding direction of the seat carrier (4), flat underneath the same, wherein for each helical compression spring (24) a counter-bearing extension arm (25) is provided, a front end of which is articulated to the base carrier (1) and a rear-facing end of which, freely projecting, forms a counter bearing (27) for a rear support of the helical compression spring (24), and wherein the at least one helical compression spring (24) is supported in each case with its front end on a counter bearing (28) formed on the seat carrier (4).

2. A synchronizing mechanism according to claim 1, wherein to adjust a pretension of the at least one helical compression spring (24), the associated counter-bearing extension arm (25) is supported slideable in the longitudinal direction (SL) on the base carrier (1).

3. A synchronizing mechanism according to claim 2, wherein the counter-bearing extension arm (25) is slideably supported on the seat carrier (4) by means of a bearing head (26) on an adjusting shaft (11) forming a transverse axis of the turning-and-sliding joint (17), said adjusting shaft (11) carrying in each case one eccentric cam (35) for adjusting the associated counter-bearing extension arm (25).

4. A synchronizing mechanism according to claim 3, wherein a spring package of multiple helical compression springs (24) is provided, a combined pretension of which is variable in narrow steps by means of a varying gradation of the individual eccentric cams (35) of the adjusting shaft (11).

5. A synchronizing mechanism according to claim 3, wherein the bearing head (26) of the given counter-bearing extension arms (25) is designed as a frame, frame walls (33) of which that extend parallel to the longitudinal direction (SL) have an elongated-hole type bearing cutout (34), by means of which the counter-bearing extension arm (25) is slideably supported on the adjusting shaft (11).

6. A synchronizing mechanism according to claim 5, wherein the front frame wall (37) of the given bearing head frame (26) is actuated by the associated eccentric cam (35).

7. A synchronizing mechanism according to claim 1, wherein the counter-bearing extension arms (25) are designed as rods on which the helical compression springs (24) are placed.

8. A synchronizing mechanism according to claim 1, wherein the at least one helical compression spring (24) as a counter bearing for the seat carrier (4) is supported via a bearing strip (28) extending perpendicular to the longitudinal direction (SL), which is pivotably slide-mounted in a bearing-cutout.

9. A synchronizing mechanism according to claim 1, wherein at least one counter-bearing extension arm (25) is provided at its rear-facing end with a supplemental counter bearing (38) that is adjustable in the longitudinal direction (SL).

10. A synchronizing mechanism according to claim 9, wherein the adjustable supplemental counter bearing is formed by a slider (39) that is slideably guided on the counter-bearing extension arm (25), said slider (39) being actuatable by an eccentric cam shaft (41).

11. A synchronizing mechanism according to claim 10, wherein the eccentric cam shaft (41) is mounted on a bearing brace (43) that extends backward from the front end of the counter-bearing extension arm (25).

12. A synchronizing mechanism according to claim 1, wherein the at least one counter-bearing extension arm (25) is executed as an adjusting shaft (51) that is rotation-driveable by an actuator (50) on the base carrier (1), said adjusting shaft (51) supporting on its rear-facing end a counter-bearing end stop (64) that can be adjusted spindle-like in the direction of the spring force of the helical compression spring (24) by a rotation of the shaft.

13. A synchronizing mechanism according to claim 12, wherein the actuator (50) incorporates an actuating shaft (52) disposed in the front region of the base carrier (1) perpendicular to the orientation of the adjusting shaft(s) (51), said actuating shaft (52) being coupled via a deflection gear (49) to the front end of the adjusting shaft(s) (51).

14. A synchronizing mechanism according to claim 13, wherein at least two adjusting shafts (51) are rotatably supported with their front end in a bearing yoke (65) disposed on a deflection gear shaft (49).

15. A synchronizing mechanism according to claim 12, wherein the deflection gear (49) incorporates a bevel gear (61) between the at least one adjusting shaft (51) and a gear shaft (57).

* * * * *